United States Patent [19]

Stelts et al.

[11] Patent Number: 4,941,646

[45] Date of Patent: Jul. 17, 1990

[54] AIR COOLED GAS INJECTION LANCE

[75] Inventors: Philip D. Stelts, Center Valley; David W. Kern, Slatedale; Kenneth J. Fioravanti, Allentown, all of Pa.

[73] Assignees: Bethlehem Steel Corporation, Bethlehem; Air Products & Chemicals, Inc., Allentown, both of Pa.

[21] Appl. No.: 276,255

[22] Filed: Nov. 23, 1988

[51] Int. Cl.[5] ..... C21C 5/32

[52] U.S. Cl. ..... 266/270; 266/225

[58] Field of Search ..... 266/225, 270

[56] References Cited

U.S. PATENT DOCUMENTS

| | | | |
|---|---|---|---|
| 2,005,311 | 6/1935 | Belding | 222/592 |
| 2,828,956 | 4/1958 | Bieniosek et al. | 239/132.3 |
| 3,200,457 | 8/1965 | Wagstaff | 222/590 |
| 3,411,528 | 11/1968 | Machiyama et al. | 137/340 |
| 3,540,467 | 11/1970 | Stelts et al. | 137/340 |
| 3,833,209 | 4/1973 | Chang | 266/225 |
| 4,326,701 | 4/1982 | Hayden | 266/225 |
| 4,520,861 | 6/1985 | Sobolewski | 164/473 |
| 4,550,898 | 11/1985 | LaBate | 266/220 |
| 4,706,944 | 11/1987 | Lee | 266/272 |
| 4,750,716 | 6/1988 | Parker | 266/225 |
| 4,767,598 | 8/1988 | Kinosz | 420/528 |
| 4,792,126 | 12/1988 | Nagy et al. | 266/270 |

FOREIGN PATENT DOCUMENTS

| | | | |
|---|---|---|---|
| 2114721 | 8/1983 | United Kingdom | 266/225 |

*Primary Examiner*—Robert McDowell

*Attorney, Agent, or Firm*—John I. Iverson

[57] ABSTRACT

An air cooled refractory covered injection lance for introducing reactive gases below the surface of a molten metal bath where the lance is provided with means to surround the reactive gas conduit with a high velocity cooling fluid to prevent thermal decomposition of the reactive gas prior to its injection into the molten metal bath.

3 Claims, 2 Drawing Sheets

AIR COOLED GAS INJECTION LANCE

BACKGROUND OF THE INVENTION

This invention relates to an air cooled refractory covered injection lance for introducing reactive gases, such as halogen gases, below the surface of a molten metal bath to remove hydrogen contained within the molten metal bath.

Many methods for hydrogen degassification of steel are known and used in modern metallurgical operations. Vacuum degassing is one such method of molten steel degassification but this method requires large capital investments for the vacuum degassing facilities. A second method of degassification is the slow cooling of steel products such as blooms and slabs, to allow the hydrogen to diffuse naturally. However, such slow cooling extends processing time, ties up inventory and requires extreme care to ensure reliable results.

It has been discovered, as further described in copending U.S. Patent application Ser. No. 276,094 filed Nov. 23, 1988, U.S. Pat. No. 4,869,749 , that rapid removal of hydrogen from molten steel can be achieved by injecting a reactive halogen containing gas, such as tetrafluoromethane or dichlorodifluoromethane or sulfur hexafluoride fluoride, below the surface of a molten steel bath through an air cooled refractory coated lance. The injected halogen containing gas combines with the hydrogen within the molten steel bath and forms a compound which readily escapes from the molten steel at atmospheric pressures. However, it has also been discovered that halogen containing gases are prone to premature thermal decomposition when subjected to extreme high temperatures in the injection lance. It has been found that unless the injection lance components which come into contact with the halogen containing gases are maintained at a relatively cool temperature, the halogen containing gases within the lance will decompose into elemental fluorine and/or chlorine which corrodes and causes premature failure of the injection lance.

SUMMARY OF THE INVENTION

It is therefore an object of this invention to provide a lance for injecting a reactive gas below the surface of a liquid metal bath.

It is a further object of this invention to prevent the thermal decomposition of a reactive gas while passing through the lance.

It is a still further object of this invention to provide a gas injection lance having means to control the temperature of the gas until such gas is discharged from the lance tip into a molten metal bath.

We have discovered that the foregoing objects can be attained with a gas injection lance comprising a first centrally located tubular conduit for conveying a reactive gas to a discharge nozzle, a second centrally located tubular conduit coaxially spaced and surrounding the first tubular conduit for conveying a gaseous cooling fluid along the outer wall of the first tubular member, a third centrally located, refractory covered, tubular conduit coaxially spaced and surrounding the second tubular member, a gas tight seal connecting the bottom end of the third tubular conduit to the outer periphery of the first tubular conduit at a point below the discharge end of the second tubular conduit and above the discharge nozzle of the lance, and, a cooling fluid exhaust means at the upper end of the third tubular conduit.

DETAILED DESCRIPTION OF THE PRESENT EMBODIMENT

Figure 1:
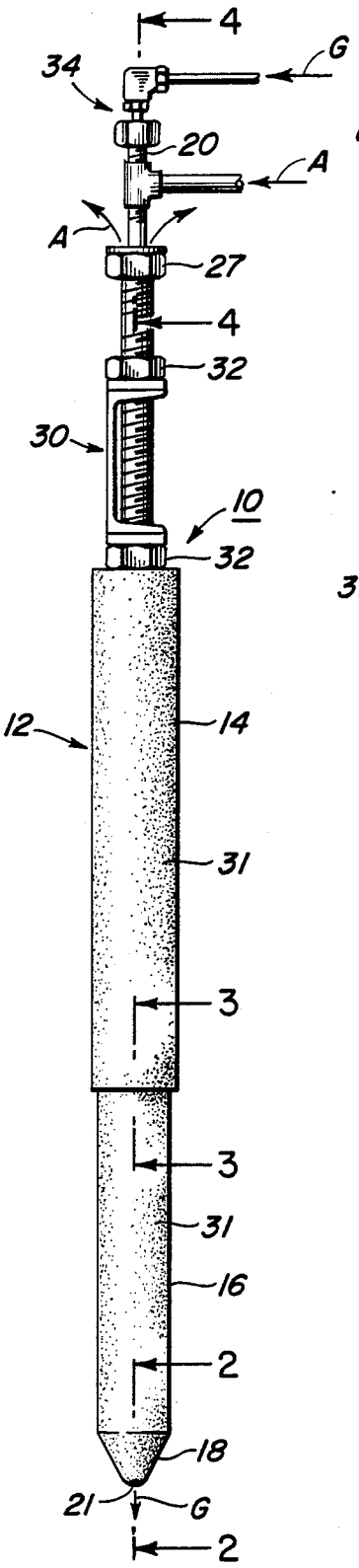
FIG. 1 is an elevational view of the preferred embodiment of the injection lance of this invention.

Referring to FIG. 1 of the drawings, an injection lance assembly 10 for introducing a reactive gas into a bath of molten metal comprises a refractory covered tubular lance 12 having an upper lance portion 14 and a lower lance portion 16, a lance support means 30 and a manifold portion 34. The lower lance portion 16 includes a conical shaped tip portion 18 for dispensing a reactive gas "G" below the surface of a molten steel bath, and the manifold portion 34 is attached to coolant and reactive gas supplies (not shown).

Figure 3:
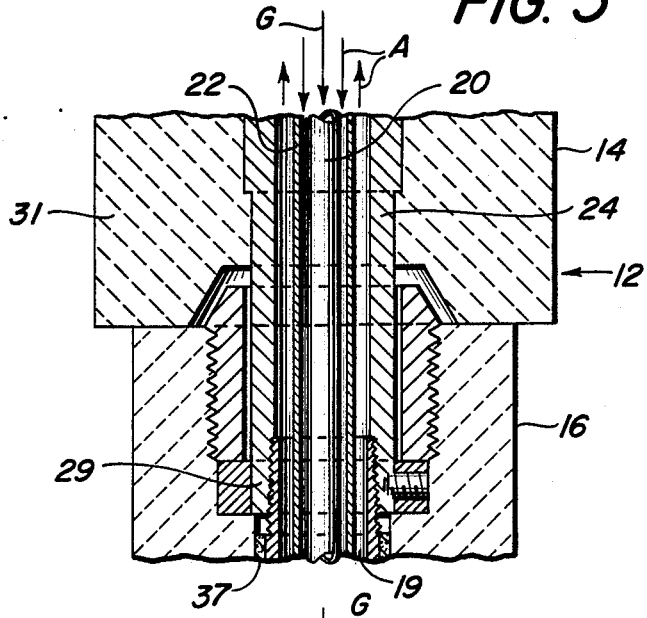
FIG. 3 is a cross-sectional view taken along the lines 3—3 of FIG. 1 showing a connection between the upper and lower lance portions of the present invention.
Figure 2:
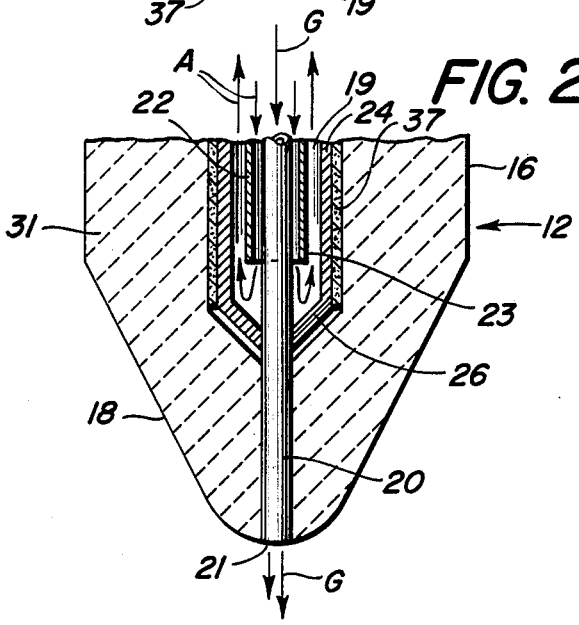
FIG. 2 is a cross-sectional view taken along the lines 2—2 of FIG. 1 showing the lance tip of the present invention.
Figure 4:
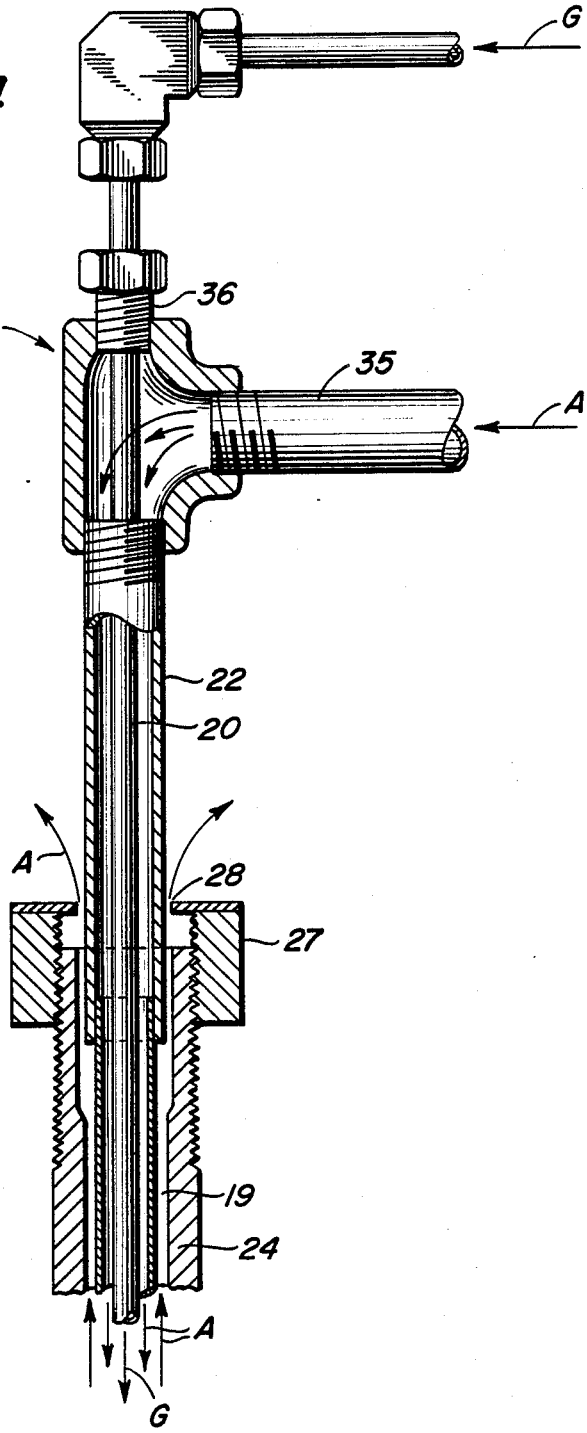
FIG. 4 is a cross-sectional view taken along the lines 4-4 of FIG. 1 showing the manifold portion of the lance of this present invention.

As shown in FIGS. 2, 3 and 4, the refractory covered tubular lance 12 comprises a first centrally located tubular conduit 20 extending from the reactive gas side 36 of manifold 34 to a discharge nozzle 21 at lance tip 18, a second centrally located tubular conduit 22 coaxially spaced and surrounding the first tubular conduit 20 extends from the coolant side 35 of manifold 34 to a discharge end 23 located in the lower lance portion 16, a third centrally located tubular conduit 24 coaxially spaced and surrounding the first and second tubular conduits 20 and 22 extends from a coolant exhaust means 27 to a point located below the discharge end 23 of the second tubular member 22 and above the discharge nozzle 21 in the conical shaped lance tip 18. A conical coolant sealing means 26 connects the lower end of the third tubular conduit 24 to the outer periphery of the first centrally located tubular conduit 20 at a point below the discharge end 23 of the second tubular conduit 22 and above the discharge nozzle 21 of the first tubular conduit 20. The third tubular conduit 24 is wrapped with an insulating sleeve 37 or wrapping before being covered with an outer refractory covering 31.

The third tubular conduit 24 is attached to the lance support means 30 by fasteners 32 and the exhaust means 27 at the upper end portion 24 is provided with an opening 28 for discharging heated coolant from the injection lance.

The upper lance portion 14 is attached to the lower lance portion 16 via a threaded connection means 29 to enable quick assembly when the lance tip is replaced.

In operation, a reactive gas "G", which must be maintained at a relatively cool temperature within the injection lance 12, is fed down the bore of the first tubular conduit 20 through the manifold means 37, as shown in FIG. 4, and is dispensed from the discharge nozzle 21 into the molten steel bath as shown in FIG. 2. The coolant "A", which cools the reactive gas, and, which in this case, is high pressure air or other suitable gas, is fed at a high velocity down the bore of the second tubular conduit 22 to the discharge end 23 where it is forced to reverse direction and flow up the space 19 between the outer wall of the second tubular conduit 22 and the inner wall of the third tubular conduit 24 to the exhaust means 27 where it exits from the injection lance through opening 28.

By making the cross-sectional area of the intervening area 19 between the outer and inner walls of the second and third tubular members 22 and 24 close to the cross-sectional area of the bore of the second tubular conduit 22, and by locating the discharge end 23 of conduit 22 above the coolant sealing means 26 by a distance substantially equal to or less than the inside diameter of the third tubular conduit 24, one achieves a very high degree of heat transfer from the refractory covering 31 to the coolant "A" due to the fact that the air is forced to travel at a very high mass flow rate. Under these conditions, high velocity cold air is forced down along the tubular conduit 20 to prevent heating the reactive gas being conveyed through conduit 20 to the discharge nozzle 21, while at the same time, high velocity cold air is forced up through the intervening space 19 to remove heat from the refractory covering 31 and expel the transferred heat through opening 28.

Although the invention has been illustrated and described in certain embodiments, it is understood that other embodiments and changes may be made without departing from the scope of the invention as set forth. For example, the tubular conduits are illustrated as being circular in cross-section, however, any suitable cross-section may be used for such members. It would also be possible to build the lance of this invention in one continuous length rather than assembling it from upper and lower lance sections as illustrated.

I claim:

1. A refractory coated lance for introducing a reactive gas into a bath of molten metal the lance comprising:

(a) a first centrally located conduit for conveying a reactive gas extending from a reactive gas supply to the lance tip, (b) a second centrally located conduit coaxially spaced and surrounding the upper portion of said first centrally located conduit for conveying a stream of gaseous cooling fluid at a high mass flow rate along the outer wall surface of said first conduit, (c) a third centrally located conduit coaxially spaced and surrounding said first and second centrally located conduits, said third conduit having an outer insulating sleeve under a covering of refractory material and a threaded connection to permit the separation of the upper and lower portions thereof, (d) a conical gas tight sealing means connecting the lower end of said third centrally conduit to outer periphery of first said centrally located conduit at a point below the discharge end of said second conduit and above the lance tip, (e) an opening at the upper end of said third centrally located conduit for discharging the high velocity gaseous cooling fluid to the atmosphere.

2. The lance of claim 1 in which the centrally located conduits are tubular members.

3. The lance of claim 1 in which the tubular members are circular in cross-section.

* * * * *